United States Patent [19]

Matthewman

[11] 4,384,268

[45] May 17, 1983

[54] MARINE NAVIGATION ASSISTING APPARATUS

[76] Inventor: Richard J. Matthewman, 2345 Confederation Pkwy., Penthouse 4, Mississauga, Ontario, Canada

[21] Appl. No.: 233,070

[22] Filed: Feb. 10, 1981

[51] Int. Cl.[3] ..... G08G 3/00; G08B 5/36

[52] U.S. Cl. ..... 340/29; 116/26; 116/DIG. 26; 340/815.1; 340/815.23

[58] Field of Search ..... 340/29, 321, 332, 372, 340/815.23, 815.1; 116/26, DIG. 43; 441/16

[56] References Cited

U.S. PATENT DOCUMENTS 2,633,818 4/1953 Garrett ..... 340/29

4,050,400 9/1977 Tatton et al. ..... 116/26

*Primary Examiner*—James J. Groody

[57] ABSTRACT

Two tri-color light emitting diodes (LEDs) are mounted in spaced apart relationship and are supplied via a switch with appropriate potentials to illuminate one LED in one color (red) and the other in another color (green) and vice versa to indicate to a boatman on which side of a buoy he should pass to remain in a channel marked by red and black buoys.

10 Claims, 2 Drawing Figures

MARINE NAVIGATION ASSISTING APPARATUS

BACKGROUND OF THE INVENTION

This invention relates to apparatus for assisting a boatman to navigate a waterway. More specifically, this invention relates to apparatus for indicating to a boatman on which side of a buoy he should pass in order to remain in the channel that is being marked by the buoy.

The channels in navigable waterways are marked on one side by black buoys and on the other side by red buoys. However, the red and black buoys do not always occur in pairs, so it is necessary for a boatman to know on which side of a red or black buoy he should pass in order to remain in the channel marked by the buoy. Depending upon the direction being travelled and the particular waterway, the boatman may have to pass either to the port and starboard of a black buoy or to the port and starboard of a red buoy. At the beginning of a trip the boatman can determine from charts and the like to which side of any given buoy he is supposed to pass. However, it often happens that this information is forgotten during the trip, and the boatman may be required to make a quick decision whether to pass to the port and starboard of a red or black buoy. If the wrong choice is made, the boatman's boat may not remain in the channel and may become grounded or even may sink.

Devices for indicating on which side a buoy should be passed are not generally new. Reference may be made, for example, to U.S. Pat. No. 2,633,818, issued Apr. 7, 1953, Harold S. Garrett and to U.S. Pat. No. 4,050,400, issued Sept. 27, 1977, Nelson Tatton et al.

The devices shown in the Garrett and Tatton et al patents do not operate based on differences in colors of channel marking buoys, but rather operate on the basis of the difference in shape of a can buoy and a nun buoy. The Garrett patent discloses an arrangement in which models of buoys of the same shape as a nun buoy and a can buoy are mounted on a rotatable turret, the position of which is adjusted before a trip depending on whether the boat is travelling upstream or downstream. The buoys are illuminated, but only in response to activation of a searchlight on the boat. No color distinction between the buoys is drawn. In the Tatton et al patent a movable slide member is disclosed carrying at both ends thereof representations of a nun buoy and a can buoy. The slide member can be moved behind a disk having apertures therein, the components being so arranged that when a nun buoy is seen through one aperture, a can buoy will be seen through the other aperture, and vice versa. The representations of the buoys are illuminated by lights, but there is no indication that any distinction is made based upon different colors of the buoys. It is disclosed in the Tatton et al patent that red and green lenses are provided, but this is only for the purpose of indicating which of two boats has the right of way.

Not all buoys marking navigable waterways may be shaped as can buoys or nun buoys but, generally speaking, channels always are marked by buoys that differ in color, red and black being the two selected colours, as previously indicated.

The instant invention thus is a very simple piece of equipment which can be set at the beginning of a trip to clearly indicate whether a black buoy should be passed on the starboard or port and the same for a red buoy.

SUMMARY OF THE INVENTION

According to one aspect of this invention there is provided apparatus for reminding a boatman of the side of a buoy on which said buoy should be passed comprising first and second light emitting devices each having first and second electrodes and each being of a type that emits light of a first color when a first potential is applied to said first electrode thereof and a second potential is applied to said second electrode thereof and of a second color different from said first color when a third potential is applied to said first electrode thereof and a fourth potential is applied to said second electrode thereof, said first and third potentials being different from each other and said second and fourth potentials being different from each other, means mounting said light emitting devices in spaced apart relationship, and switching means connected to said light emitting devices and adapted for connection to a source of said potentials, said switching means being so connected to said light emitting devices as to be adapted to supply in one position of said switching means said first and second potentials to said first and second electrodes respectively of said first light emitting device and said third and fourth potentials to said first and second electrodes respectively of said second light emitting device, whereby said first and second light emitting devices emit said first and second colors respectively, and in another position of said switching means said first and second potentials to said first and second electrodes respectively of said second light emitting device and said third and fourth potentials to said first and second electrodes respectively of said first light emitting device, whereby said first and second light emitting devices emit said second and first colors respectively whereby when proceeding in a channel marked by starboard and port buoys of two different colors a boatman can set the starboard side one and the port side one of light emitting devices to emit colors that indicate to the boatman the colors of the starboard and port buoys respectively and thereby remind the boatman on which side any one of such buoys should be passed.

BRIEF DESCRIPTION OF THE DRAWINGS

This invention will become more apparent from the following detailed description, taken in conjunction with the appended drawings, in which.

DETAILED DESCRIPTION OF THE INVENTION INCLUDING THE PREFERRED EMBODIMENT

Figure 1:
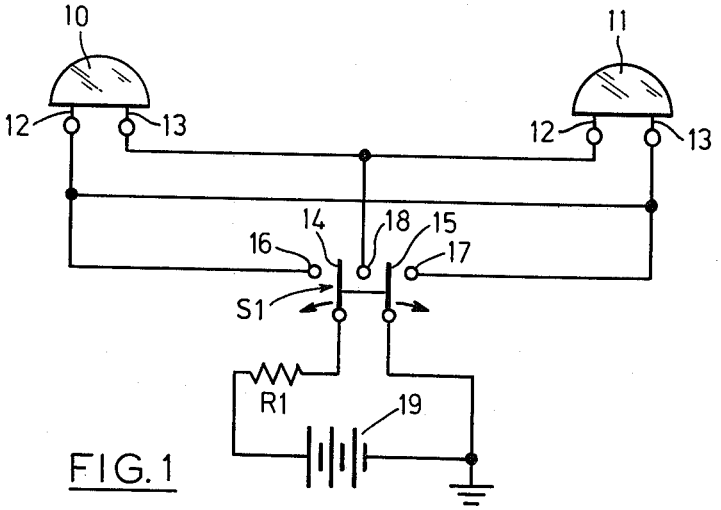
FIG. 1 is a circuit diagram of apparatus embodying the instant invention.
Figure 2:
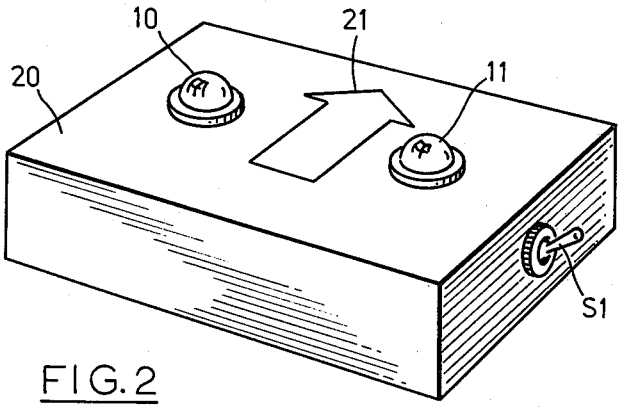
FIG. 2 is a perspective view of apparatus embodying the instant invention as it may be mounted in the wheelhouse or on the bridge of a boat in a position where it can be seen by the helmsman.

Referring first to FIG. 2, apparatus embodying the instant invention includes two light emitting devices 10 and 11 which, preferably, are identical. Each of the devices has electrodes 12 and 13 (FIG. 1), and each device 10 and 11 is of a type that emits light of a first color when first and second potentials are applied to its electrodes 12 and 13 respectively and light of a second color different from the first color when third and fourth potentials are applied to electrodes 12 and 13 respectively thereof, the first and third potentials being different from each other and the second and fourth potentials being different from each other.

In a preferred embodiment of the invention devices 10 and 11 are tri-color light emitting diodes (LEDs). A tri-color LED is characterized by a capability of turning either red, green or orange depending upon the polarity of the voltage applied thereto. Thus, if one electrode of the tri-color LED is grounded, and a positive voltage is applied to its other electrode, the LED will emit red light. If the connections are reversed, the LED will emit green light, while if a negative voltage is applied to one of its electrodes and the other is grounded, the LED will emit an orange light. In the practice of the instant invention, the latter capability of a tri-color LED is not used.

Referring to FIG. 1, a two-position, two-pole switch S1 having switch blades 14 and 15 that are ganged together is provided. A terminal 16 is connected to electrode 12 of LED 10 and to electrode 13 of LED 11. A terminal 17 is connected to electrode 13 of LED 11 and electrode 12 of LED 10. A third terminal 18 is connected to electrodes 13 and 12 of LEDs 10 and 11 respectively.

Switch blade 14 is connected via a resistor R1 to the positive terminal of a suitable potential source 19, which may be a battery. Resistor R1 merely serves as a voltage dropping resistor and ensures that the correct voltage (1.5 volts) is applied to the LEDs 10 and 11. Of course, if a 1.5 volt battery 19 is employed, resistor R1 could be eliminated. On the other hand, two resistors and an appropriate switching arrangement could be employed in the event that it was desired to illuminate the LEDs at high and low levels. The other terminal of the battery is grounded as shown and is connected to switch blade 17.

When switch S1 is moved to the left-hand position thereof, blade 14 will contact terminal 16, and blade 15 will contact terminal 18. Thus a positive potential will be applied to electrodes 12 and 13 of LEDs 10 and 11 respectively, while electrodes 13 and 12 of LEDs 10 and 11 will be grounded. Under these circumstances LED 10 will emit a red light, while LED 11 will emit a green light. However, when switch S1 is moved to its right-hand position, switch blade 15 will contact terminal 17, and switch blade 14 will contact terminal 18. Under these circumstances electrodes 13 and 12 of LEDs 10 and 11 respectively will be at a positive potential, while electrodes 12 and 13 of LEDs 10 and 11 respectively will be grounded resulting in LED 10 emitting a green light and LED 11 emitting a red light.

As shown in FIG. 2, LEDs 10 and 11 are mounted in spaced apart relationship on a housing 20 on which switch S1 also is mounted. Wires (not shown) lead from the housing to battery 19, and switch terminals 16, 17 and 18 are wired within housing 20 to LEDs 10 and 11 in the manner indicated in FIG. 1.

Marked on housing 20 is an arrow 21 which points in the direction of travel of the boat, i.e., either upstream or downstream.

The apparatus of the instant invention is located in the wheelhouse or on the bridge of a boat in a location where it can be readily seen by the helmsman with arrow 21 pointing either upstream or downstream depending upon whether the boat will be moving upstream or downstream. The boatman consults his chart prior to a trip and determines where the red and black buoys should be located. By way of example, it will be assumed that a red buoy should be on the boatman's port side, while a black buoy should be on the boatman's starboard side. Under these circumstances the boatman will activate switch S1 so that LED 11 emits red light and LED 10 emits green light, which stands for black. From then on, until such time as the channel markers should change, all the boatman needs to do is to look at the apparatus of this invention, and he can readily determine that a red buoy always should be passed to be on the left-hand boatman's port side and a black buoy always should be passed to be on the boatman's starboard side.

When the boat is turned around, all that is necessary is to reverse switch S1 so that LED 11 becomes green and LED 10 becomes red, indicating that a red buoy should be passed on the boatman's starboard side and a black buoy on the boatman's port side.

While preferred embodiments of the invention have been described herein, those skilled in the art will appreicate that changes and modifications may be made therein without departing from the spirit and scope of this invention as defined in the appended claims.

I claim:

1. Apparatus for reminding a boatman of the side of a buoy on which said buoy should be passed comprising first and second light emitting devices each having first and second electrodes and each being of a type that emits light of a first color when a first potential is applied to said first electrode thereof and a second potential is applied to said second electrode thereof and of a second color different from said first color when a third potential is applied to said first electrode thereof and a fourth potential is applied to said second electrode thereof, said first and third potentials being different from each other and said second and fourth potentials being different from each other, means mounting said light emitting devices in spaced apart relationship, and switching means connected to said light emitting devices and adapted for connection to a source of said potentials, said switching means being so connected to said light emitting devices as to be adapted to supply in one position of said switching means said first and second potentials to said first and second electrodes respectively of said first light emitting device and said third and fourth potentials to said first and second electrodes respectively of said second light emitting device, whereby said first and second light emitting devices emit said first and second colors respectively, and in another position of said switching means said first and second potentials to said first and second electrodes respectively of said second light emitting device and said third and fourth potentials to said first and second electrodes respectively of said first light emitting device, whereby said first and second light emitting devices emit said second and first colors respectively whereby when proceeding in a channel marked by starboard and port buoys of two different colors a boatman can set the starboard side one and the port side one of light emitting devices to emit colors that indicate to the boatman the colors of the starboard and port buoys respectively and thereby remind the boatman on which side any one of such buoys should be passed.

2. Apparatus according to claim 1 wherein said light emitting devices are light emitting diodes.

3. Apparatus according to claim 2 wherein said light emitting diodes are tri-color light emitting diodes.

4. Apparatus according to claim 1 wherein said colors are red and green.

5. Apparatus according to claim 1 wherein said first and fourth potentials are the same and said second and third potentials are the same.

6. Apparatus according to claim 5 wherein said first and fourth potentials are a positive potential and said second and third potentials are ground potential.

7. Apparatus according to claim 6 wherein said light emitting devices are light emitting diodes.

8. Apparatus according to claim 7 wherein said light emitting diodes are tri-color light emitting diodes.

9. Apparatus according to claim 8 wherein said first and second colors are red and green.

10. Apparatus according to claim 1 including means associated with said apparatus for indicating the direction of travel of a boat with which said apparatus is used.

* * * * *